US005822039A

United States Patent [19]

Nishida et al.

[11] Patent Number: 5,822,039

[45] Date of Patent: Oct. 13, 1998

[54] PHOTOGRAPHIC PRINTING AND DEVELOPING APPARATUS

[75] Inventors: Shigeki Nishida; Toru Tanibata, both of Wakayama, Japan

[73] Assignee: Noritsu Koki Co., Ltd., Wakayama, Japan

[21] Appl. No.: 911,046

[22] Filed: Aug. 14, 1997

Related U.S. Application Data

[63] Continuation of Ser. No. 522,833, Sep. 1, 1995, abandoned, which is a continuation-in-part of Ser. No. 190,837, Feb. 3, 1994, abandoned.

[30] Foreign Application Priority Data

Feb. 18, 1993 [JP] Japan ..... 5-045850

[51] Int. Cl.[6] ..... B03B 27/52

[52] U.S. Cl. ..... 355/27; 396/311; 396/570

[58] Field of Search ..... 355/27; 396/811, 396/570

[56] References Cited

U.S. PATENT DOCUMENTS

| | | | |
|---|---|---|---|
| 2,296,048 | 9/1942 | Planskoy | 355/27 |
| 3,462,221 | 8/1969 | Tajima et al. | 355/27 |
| 3,995,959 | 12/1976 | Sheber | 354/297 |
| 4,293,211 | 10/1981 | Kaufmann | 354/298 |
| 4,527,878 | 7/1985 | Taniguichi et al. | 354/298 |
| 4,603,456 | 8/1986 | Baker | 354/298 |
| 4,611,918 | 9/1986 | Nishida et al. . | |
| 4,985,320 | 1/1991 | Griffin | 430/30 |
| 5,083,152 | 1/1992 | Tokuda | 355/27 |
| 5,083,154 | 1/1992 | Terashita et al. | 355/68 |
| 5,194,887 | 3/1993 | Farling et al. | 354/297 |
| 5,223,881 | 6/1993 | Nakagawa et al. | 354/298 |
| 5,223,890 | 6/1993 | Sakakibana et al. | 355/75 |
| 5,233,386 | 8/1993 | Terashita | 355/41 |
| 5,289,232 | 2/1994 | Seto | 355/75 |
| 5,319,408 | 6/1994 | Shiota | 354/298 |

FOREIGN PATENT DOCUMENTS

| | | |
|---|---|---|
| 0 149 850 | 7/1985 | European Pat. Off. . |
| WO 82/01940 | 6/1982 | WIPO . |

*Primary Examiner*—Daniel P. Malley
*Attorney, Agent, or Firm*—Oblon, Spivak, McClelland, Maier & Neustadt, P.C.

[57] ABSTRACT

A photographic printing and developing apparatus includes an exposure section in which a standard exposure is effected on a photosensitive material under predetermined conditions in a manner similar to that for preparing a conventional control strip. The apparatus further includes a device for measuring the density of the developed photosensitive material, and a device for displaying the condition of the processing solution which is determined based on the measured density. A negative film is prepared for the standard exposure. The apparatus is provided with a control section which selectively uses different light sources for ordinary printing and for the standard exposure. The control section reads in the measured density of the photosensitive material after the developing process, and calculates the condition of the processing solution based on the measured density. It is judged whether or not the condition of the processing solution is within a usable range, and the results of judgment are displayed.

5 Claims, 7 Drawing Sheets

FIG. 10

— O K —

| | WHITE | | GRAY | | BLACK |
|---|---|---|---|---|---|
| | 0.05(LOWER LIMIT) | | 0.75(LOWER LIMIT) | | 2.35(LOWER LIMIT) |
| B | 0.07(CURRENT) | B | 0.80(CURRENT) | B | 2.40(CURRENT) |
| | 0.09(UPPER LIMIT) | | 0.85(UPPER LIMIT) | | 2.45(UPPER LIMIT) |
| | 0.05(LOWER LIMIT) | | 0.75(LOWER LIMIT) | | 2.35(LOWER LIMIT) |
| G | 0.07(CURRENT) | G | 0.80(CURRENT) | G | 2.40(CURRENT) |
| | 0.09(UPPER LIMIT) | | 0.85(UPPER LIMIT) | | 2.45(UPPER LIMIT) |
| | 0.05(LOWER LIMIT) | | 0.75(LOWER LIMIT) | | 2.35(LOWER LIMIT) |
| R | 0.07(CURRENT) | R | 0.80(CURRENT) | R | 2.40(CURRENT) |
| | 0.09(UPPER LIMIT) | | 0.85(UPPER LIMIT) | | 2.45(UPPER LIMIT) |

PHOTOGRAPHIC PRINTING AND DEVELOPING APPARATUS

This application is a Continuation of application Ser. No. 08/522,833, filed on Sep. 1, 1995, now abandoned, which is a Continuation in part of application Ser. No. 08/190,837, filed on Feb. 3, 1994, also abandoned.

BACKGROUND OF THE INVENTION

1. Field of the Invention

The present invention relates to a photographic printing and developing apparatus for printing and developing a photosensitive material, and more particularly to a photographic printing and developing apparatus with which the condition of a processing solution is monitored for controlling the processing solution.

2. Discussion of Related Art

Conventional photographic printing and developing apparatuses for printing and developing photosensitive materials include an exposure section, a developing section, a drying section, etc. Currently, automatic photographic printing and developing apparatuses which include a CPU for controlling various factors which affect the printing and developing processes are widely used. In the use of such automatic printing and developing apparatuses, a processing solution used in the developing process must be controlled with the greatest care.

Controlling of a processing solution in the developing section is generally carried out by the use of a photosensitive material, called control strip. The control strip is an undeveloped printing paper which has predetermined reproductive characteristics and has been exposed to light under standard exposure conditions in which the intensity of light, exposure time and the characteristics of light are previously determined. After the control strip is developed, the density of the control strip is measured to determine the exhaustion degree of the processing solution.

Since the control strip must be processed in the dark, it is put in a dark box, called "control strip holder", in a darkroom. The control strip is then set in a receiving inlet of the developing section of a photographic printing and developing apparatus together with a holder therefore.

As described above, in conventional photographic printing and developing apparatuses, controlling of the processing solution is carried out based on the results obtained by developing the control strip housed in the control strip holder. However, the control strip holder involves drawbacks in that the mechanism for receiving the control strip is not simple due to the necessity of light-shielding, causing a troublesome operation for loading the control strip into the control strip holder.

Moreover, at the time of setting a control strip holder in a photographic printing and developing apparatus, a complicated operation is required because of the requirement of complete shielding of light. For checking the condition of the processing solution, it is required to stop the general printing processes, and then to set a control strip holder containing a control strip in the photographic printing and developing apparatus.

Since a control strip must be prepared by exposing a printing paper under special standard exposure conditions, it is separately prepared in a step independent from the ordinary printing step using a photographic printing and developing apparatus.

In many cases, however, processing solutions are controlled without the use of a control strip, because the loading of the control strip into the control strip holder and the setting of the control strip holder into the photographic printing and developing apparatus are cumbersome, and the control strip must be specially prepared as a material for controlling the processing solution. In such cases, controlling of the processing solutions is carried out by a well-trained operator who intuitively determines the condition of the processing solution based on the frequency of processing, operation cycle time of the photographic printing and developing apparatus, and the quality of the obtained photographs.

In such, there is a possibility that a misjudgment of the operator may happen in controlling the processing solution, which will allow deteriorated developing. Further, hiring of well-trained operators is against the automation and simplification of processing.

SUMMARY OF THE INVENTION

An object of the present invention is to provide an improved photographic printing and developing apparatus in which the processing solution can be controlled easily.

Another object of the present invention is to provide an improved photographic printing and developing apparatus with which the printing and developing processes are simplified, and the quality of photographs is improved.

Briefly, a photographic printing and developing apparatus according to the present invention is characterized by including an exposure section for effecting a standard exposure on a photosensitive material under predetermined conditions, means for measuring a density of the photosensitive material after development, and means for indicating the condition of the processing solution based on the data of measured density.

Here, an explanation is given as to the "standard exposure". Conventionally, an undeveloped photosensitive material which has been exposed under predetermined conditions (intensity of light, exposure time and characteristics of light) is used as a control strip. The control strip is passed through a processing solution for determining the condition of the processing solution based on the color developed. The exposure effected under such predetermined conditions to provide a control strip is called "standard exposure". In the present invention, a standard exposure is effected in the exposure section provided in the photographic printing and developing apparatus.

According to the present invention, since the standard exposure can be effected in the exposure section of the photographic printing and developing apparatus to prepare a "substitute" control strip for conventional control strips, troublesome works involved in the loading of a control strip into a control strip holder and setting of the control strip holder to the photographic printing and developing apparatus can be eliminated, by which checking and indicating of the condition of the processing solution is achieved as easy as in ordinary printing and developing. Moreover, since the processing solution is automatically controlled, a stable quality of developing can be secured. Furthermore, since it is not necessary to keep special materials for controlling processing solutions, printing processes of photographs can be simplified.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiment when considered in connection with the accompanying drawings, in which:

FIG. 10 is an explanatory illustration showing a display on a monitor used in the photographic printing and developing apparatus according to the embodiment.

DETAILED DESCRIPTION OF PREFERRED EMBODIMENTS

Figure 1:
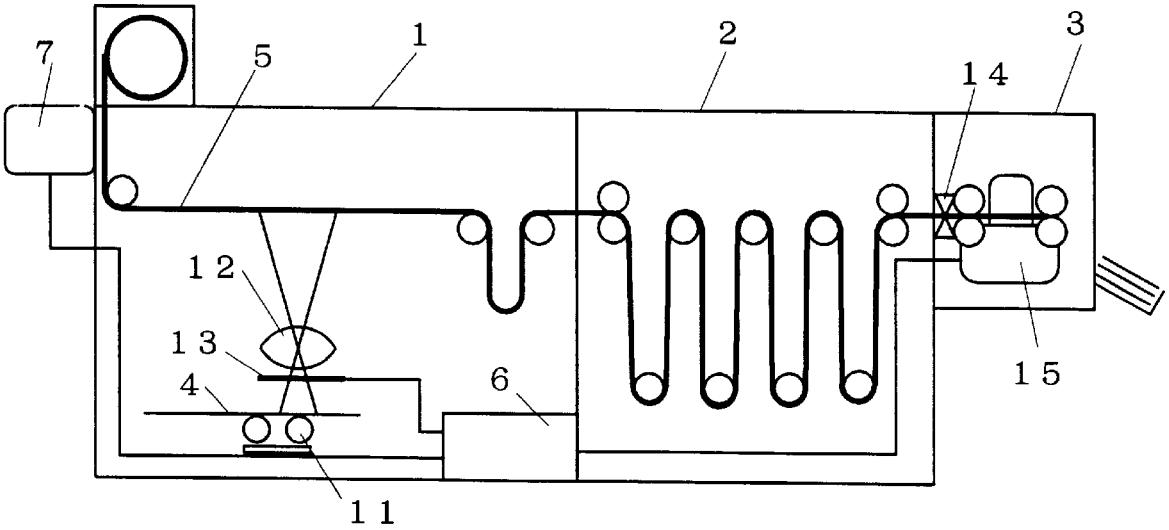
FIG. 1 is a schematic sectional view showing a photographic printing and developing apparatus according to an embodiment of the present invention.

The present invention will now be described with reference to the accompanying drawings. FIG. 1 is a schematic sectional view showing a photographic printing and developing apparatus according to an embodiment of the present invention. The photographic printing and developing apparatus is mainly composed of an exposure section 1, a developing section 2, a density measurement section 3, a control section 6 and a monitor 7. Numeral 4 denotes a negative film, and numeral 5 denotes a photosensitive material such as a printing paper. A lamp 11, a lens 12 and a shutter 13 are disposed in the exposure section 1 for exposing the photosensitive material 5. In the density measuring section 3, a cutter 14 is disposed for cutting the photosensitive material 5 into a predetermined length. A densitometer 15 is also disposed in the density measuring section 3 for measuring the density of the photosensitive material 5.

When it is required to check the condition of the processing solution, the photosensitive material 5 is exposed in the exposure section 1 using a standard negative film which will be described later as the film 8. In this case, the lamp 11, lens 12 and shutter 13 are set in accordance with predetermined standard conditions. The photosensitive material 5 exposed under the standard conditions is transferred to the developing section 2 for developing, and then transferred to the density measurement section 3 in which the density of the photosensitive material 5 is measured by the densitometer 15. The measured values are displayed on the monitor 7 as data indicating whether or not the status of the processing solution is in a predetermined usable range.

Figure 2:
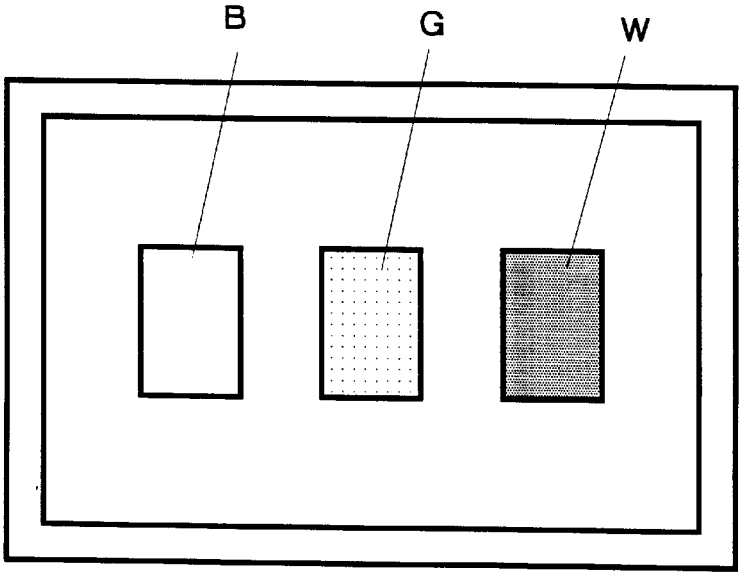
FIG. 2 is an explanatory illustration showing an example of a standard negative film used in the photographic printing and developing apparatus according to the embodiment.

To obtain the standard exposure, the lamp 11, lens 12 and shutter 13 are adjusted in accordance with predetermined standard conditions. FIG. 2 is an explanatory illustration showing an example of the standard negative film used in the photographic printing and developing apparatus according to this embodiment. The standard negative film is a special negative film which is used only for the standard exposure, and which is formed with a white area W, a gray area G and a black area B each having a predetermined density, as shown in FIG. 2.

Figure 3:
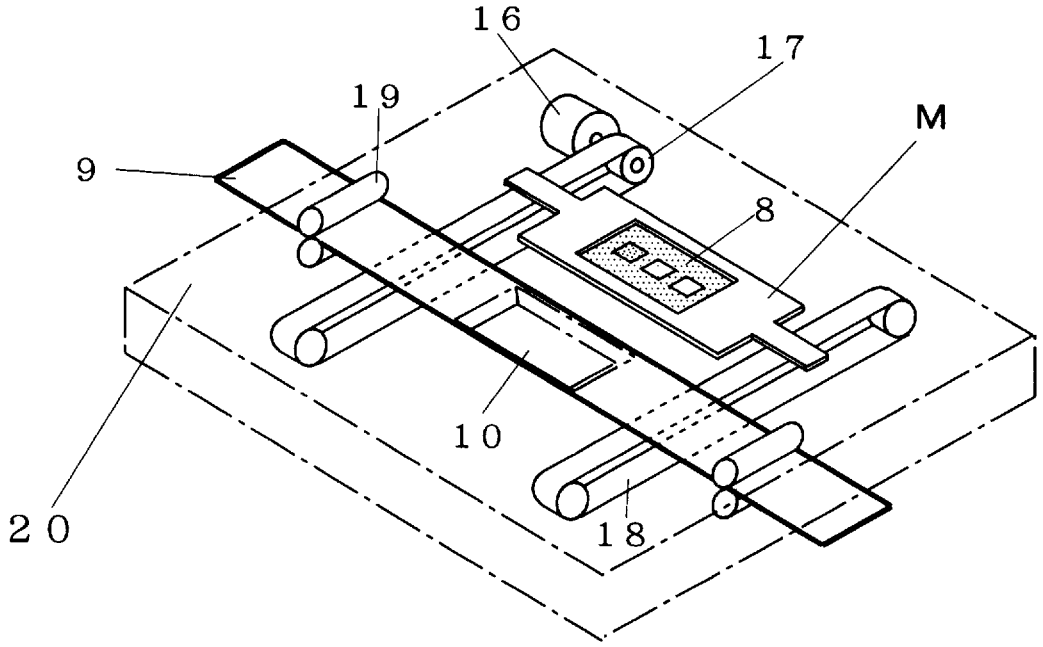
FIG. 3 is a schematic perspective view showing an example of an exposure section of the photographic printing and developing apparatus according to the embodiment.
Figure 4:
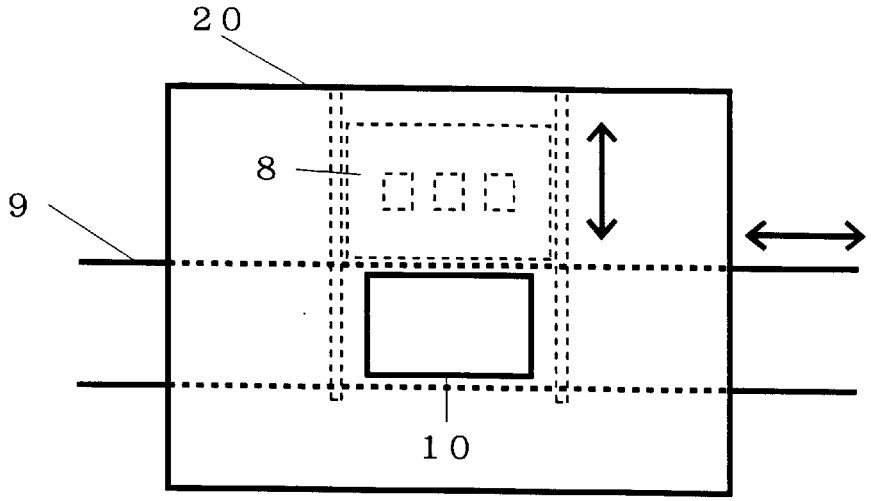
FIG. 4 is an explanatory illustration showing the operation of the exposure section shown in FIG. 3.
Figure 5:
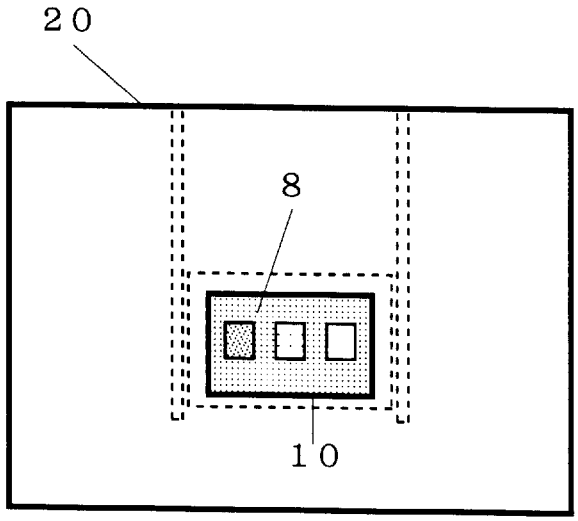
FIG. 5 is an explanatory illustration showing the operation of the exposure section shown in FIG. 3.

FIG. 3 is a schematic perspective view showing an example of the exposure section 1, and FIGS. 4 and 5 are explanatory illustrations showing the operation of the exposure section 1. In the drawings, numeral 8 indicates a standard negative film, numeral 9 denotes an ordinary negative film used for printing, numeral 10 denotes a rectangular opening, numeral 16 denotes a motor 16, numeral 17 denotes pulleys, numeral 18 denotes belts, numeral 19 denotes rollers for transferring the negative film 9, numeral 20 denotes a negative film mask, and M denotes a mount. Among them, the standard negative film 8, the ordinary negative film 9, the rectangular opening 10 and the mask 20 are illustrated in FIGS. 4 and 5 for illustrating the operation of the exposure section 1. As shown in FIG. 3, the ordinary negative film 9 is continuously transferred by the transferring rollers 19. The motor 16 is driven for transferring the standard negative film 8 when the ordinary film is not transferred. When the motor 16 is driven, the belts 18 supporting the mount M are moved via the pulleys 17. Thus, the standard negative film 8 attached to the mount M travels between an exposure position corresponding to the opening 10 and a retreat position as shown in FIG.3.

When the standard negative film 8 is located at the retreat position, the ordinary negative film 9 is passed across the negative film mask 20. As shown in FIG. 4, the negative film 9 passes behind the opening 10 as viewed from the lower side of the negative film mask 20. When a button on an operational panel (not illustrated) is operated for commanding a standard exposure, the standard negative film 8 supported by the mount M is advanced from the retreat position to the exposure position corresponding to the opening 10 so that the opening 10 is covered by the standard film 8, as shown in FIG. 5.

For obtaining a light source for the standard exposure, a special light source may be provided other than the light source for ordinary printing. In such a case, the light sources are selectively used. Alternatively, a common light source may be used for both the ordinary printing and the standard exposure. For performing a standard exposure, the voltage supplied to the light source is automatically adjusted to the predetermined level for the standard exposure.

Figure 6:
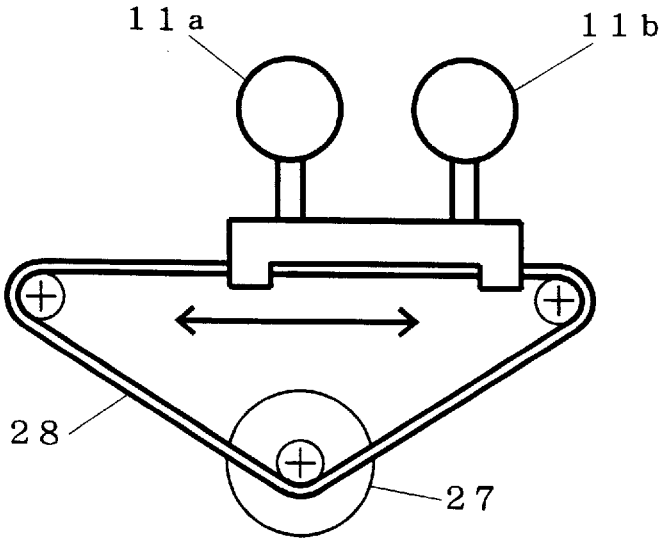
FIG. 6 is an example of a light source used in the photographic printing and developing apparatus according to the embodiment.

FIG. 6 is an example of a light source in which an additional light source for the standard exposure is provided. In the drawing, numeral 11*a* denotes a lamp for the standard exposure, numeral 11*b* denotes a lamp for the ordinary printing, numeral 27 denotes a motor and numeral 28 denotes a belt. The lamps 11*a* and 11*b* are mounted on the belt 28 which is moved by the motor 27. The motor 27 is energized in response to a command input from the operation panel so that one of the lamps 11*a* and 11*b* is positioned at an exposure position.

Figure 7:
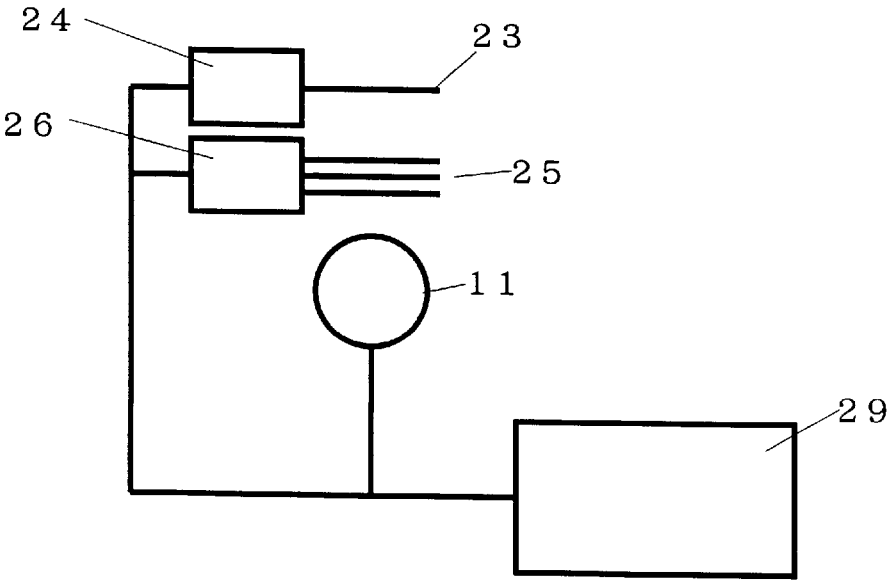
FIG. 7 is a schematic sectional view showing another example of a light source used in the photographic printing and developing apparatus according to the embodiment.

FIG. 7 is a schematic sectional view showing the light source in which a common light source is used for the ordinary printing and for the standard exposure. In this case, the light source must be controlled so that the conditions for standard exposure are met. In the drawing, numeral 11 denotes the lamp, numeral 23 denotes a mechanical shutter, numeral 24 denotes a shutter actuation section, numeral 25 denotes light controlling filters, numeral 26 denotes a filter drive section, and numeral 29 denotes a control section. The quantity of light and the color temperature are detected by a sensor (not illustrated), upon which the control section 29 automatically controls the voltage applied to the lamp 11, and the light controlling filters 25. The light controlling filters 25 are YMC color filters, and they are advanced or retracted to control the color of the exposure light.

Figure 8:
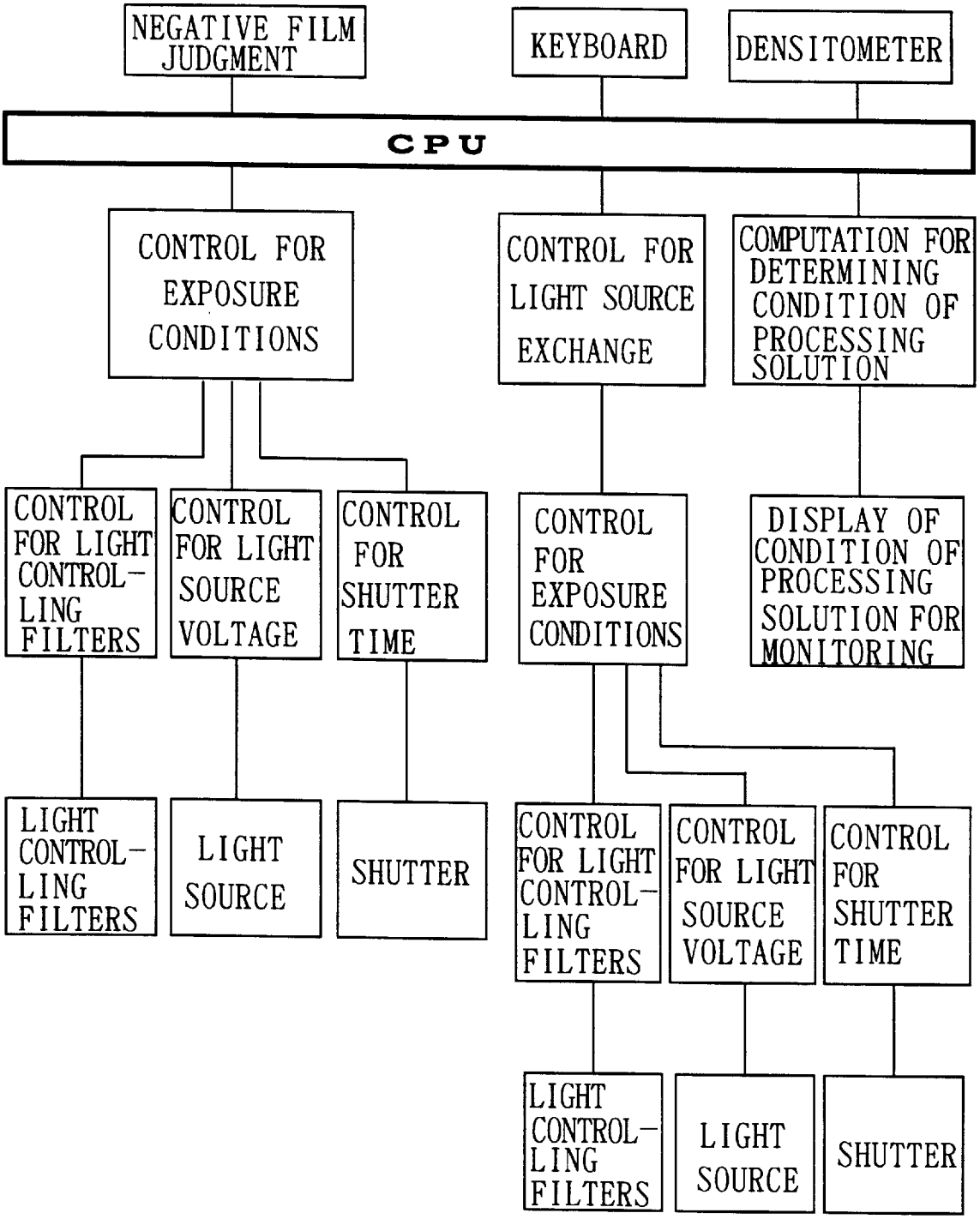
FIG. 8 is a block diagram showing an example of the control section used in the photographic printing and developing apparatus according to the embodiment.

FIG. 8 is a block diagram showing an example of the control section 6 used in the photographic printing and developing apparatus according to the embodiment. The control section 6 includes functional blocks which responds to input signals from a keyboard for selecting one of the light sources and for controlling the exposure conditions for effecting a standard exposure. The control section 6 also includes functional blocks for calculating the condition of the processing solution based on data output from the densitometer 15 and for displaying the condition. Functional blocks illustrated by thin lines form a control portion for setting exposure conditions for ordinary printing based on data obtained by detecting the kind of a negative film and input signals from the keyboard.

Figure 9:
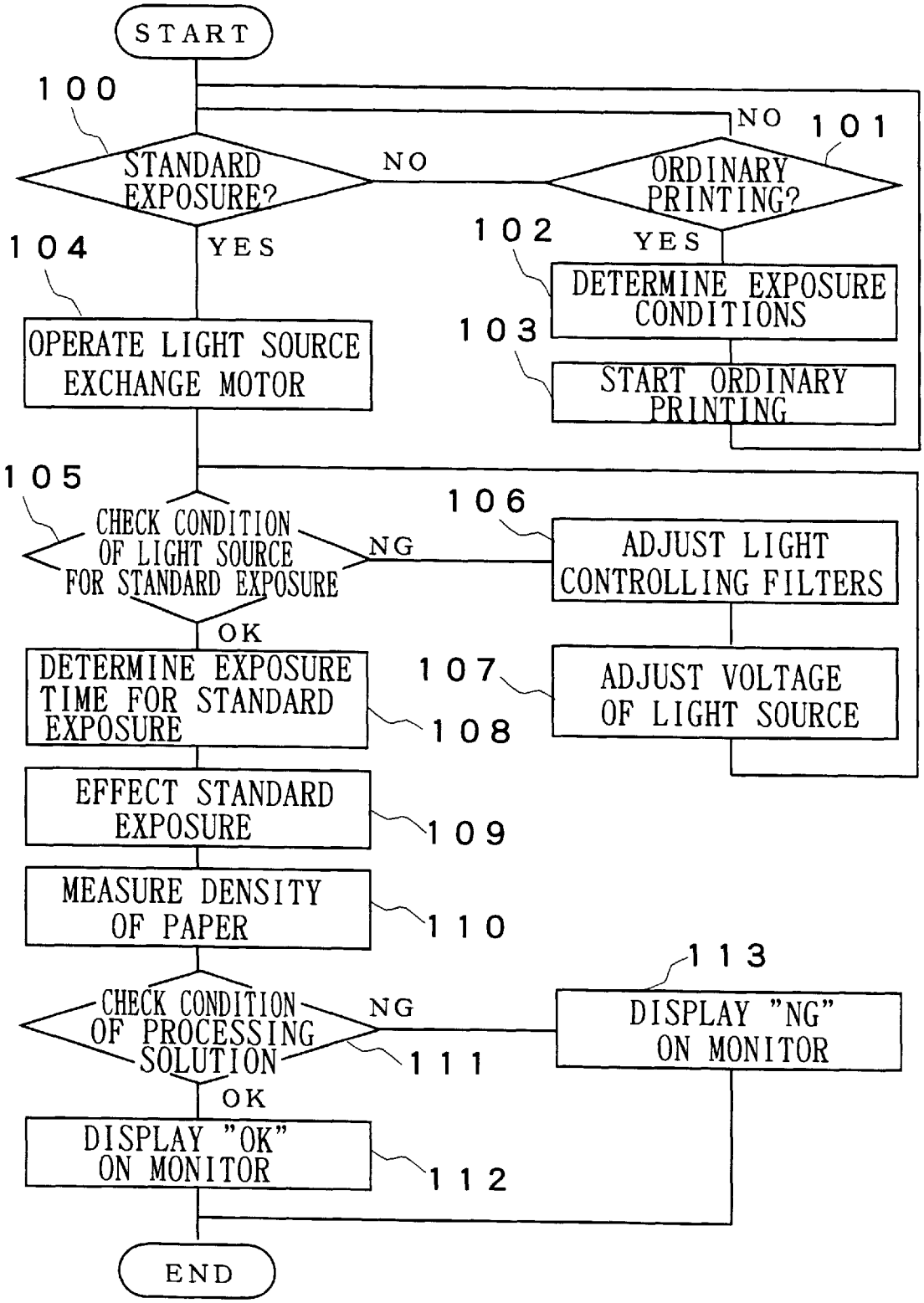
FIG. 9 is a flowchart showing operation of a control section used in the photographic printing and developing apparatus according to the embodiment.

FIG. 9 is a flowchart showing the operation of the photographic printing and developing apparatus according to the embodiment.

In cases where standard exposure is not commanded, the processes in steps 101, 102 and 103 are repeated for carrying out ordinary printing.

When it is detected in step 100 that standard exposure is commanded, the process moves from step 100 to step 104, in which the motor 27 for exchanging the light sources is activated so that the light source 11*a* for standard exposure is located at the exposure position. In steps 105, 106 and 107, the condition of the light source for standard exposure is checked and adjusted in accordance with the standard exposure conditions. In step 108, the exposure time (shutter time) for standard exposure is determined. Subsequently, a standard exposure is effected on the printing paper 5 in step 109.

After the printing paper 5 is developed, the density of the paper 5 is measured in step 110, and the condition of the processing solution is calculated based on the density. Information indicating the condition of the solution is then displayed on the monitor 7 as shown in FIG. 10. After that, it is determined in step 111 whether or not the condition of the processing solution is within a predetermined usable range. When it is judged that the condition is within the predetermined usable range, "OK" is displayed on the monitor 7 in step 112. On the contrary, when it is judged that the condition is outside the predetermined usable range, "NG" is displayed on the monitor 7 in step 113.

FIG. 10 is an explanatory illustration of a display for monitoring the condition of the processing solution used in the photographic printing and developing apparatus according to the embodiment. As FIG. 10 shows, the display presents information concerning the upper limits and lower limits of densities for the primary three colors, measured density values for each color and information indicating whether or not the processing solution currently used is still usable.

The above-described standard exposure and determination of the condition of the processing solution may be carried out at predetermined intervals in response to, for example, a signal from a timer. Also, they may be carried out every time when a predetermined number of photographs are printed. Further, the photographic printing and developing apparatus may be controlled such that it is stopped if the standard exposure and the determination of the condition of the processing solution has not been carried out for a predetermined period of time. The operation of the control section 6 may be modified in such a way that the printing and developing procedure are automatically stopped after elapse of predetermined period of time, without checking the condition of the processing solution.

Obviously, numerous modifications and variations of the present invention are possible in light of the above teachings. It is therefore to be understood that within the scope of the appended claims, the present invention may be practiced otherwise than as specifically described herein.

What is claimed is:

1. A photographic printing and developing apparatus for performing printing and developing a photosensitive material, comprising:

exposure condition control means for effecting exposure of a photosensitive material through a standard negative film having a predetermined density, with exposure conditions of a shutter, lens, and a lamp being adjusted to predetermined values;

density measurement means for measuring a density of the photosensitive material which has been printed upon exposure by said exposure condition control means and which has subsequently been developed using said processing solution;

calculating and displaying means for calculating the condition of the processing solution based on the density measured with said density measurement means and for displaying the calculated condition of the processing solution; and means for transferring a mount which accommodates said standard negative film between an exposure position at which said exposure is effected using said negative film, and a retreat position apart from the exposure position.

2. A photographic printing and developing apparatus for performing printing and developing a photosensitive material, comprising:

exposure condition control means for effecting exposure of a photosensitive material through a standard negative film having a predetermined density, with exposure conditions of a shutter, lens, and a lamp being adjusted to predetermined values;

density measurement means for measuring a density of the photosensitive material which has been printed upon exposure by said exposure condition control means and which has subsequently been developed using said processing solution;

calculating and displaying means for calculating the condition of the processing solution based on the density measured with said density measurement means and for displaying the calculated condition of the processing solution; and means for transferring a mount which accommodates said standard negative film between an exposure position at which said exposure is effected using said negative film, and a retreat position apart from the exposure position, said means for transferring a mount including:

a motor, belts which support the mount, and pulleys, and the belts being driven by the motor via the pulleys.

3. The photographic printing and developing apparatus according to claim 2 wherein said means for transferring a mount include a means for moving said mount perpendicular to a conveying direction of a printing film.

4. A photographic printing and developing apparatus according to claim 2 further including a negative film mask wherein an ordinary printing film is passed across said negative film mask and wherein said negative film mask includes an opening wherein said opening is covered by said ordinary printing film when ordinary exposure is performed and said opening is covered by said negative film when said negative film is advanced to said exposure position for standard exposure.

5. The photographic printing and developing apparatus according to claim 2 further including a means for conveying a printing film wherein said means for transferring said mount is actuated when said means for conveying is not actuated.

* * * * *

UNITED STATES PATENT AND TRADEMARK OFFICE

CERTIFICATE OF CORRECTION

PATENT NO. : 5,822,039

DATED : October 13, 1998

INVENTOR(S) : Shigeki NISHIDA, et al.

It is certified that error appears in the above-identified patent and that said Letters Patent is hereby corrected as shown below:

On the title page, Item [30], the Foreign Application Priority Data, is incorrect. It should read:

--Feb. 10, 1993 [JP] Japan.....5-045850--

Signed and Sealed this

Eleventh Day of May, 1999

*Attest:*

*Attesting Officer*

Q. TODD DICKINSON

*Acting Commissioner of Patents and Trademarks*